US006234832B1

(12) United States Patent
Belopolsky et al.

(10) Patent No.: US 6,234,832 B1
(45) **Date of Patent: *May 22, 2001**

(54) DOUBLE ROW MODULAR GANG JACK FOR BOARD EDGE APPLICATION

(75) Inventors: Yakov Belopolsky, Harrisburg, PA (US); David J. Dutkowsky, Tokyo (JP)

(73) Assignee: Berg Technology, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/043,045

(22) PCT Filed: Sep. 12, 1996

(86) PCT No.: PCT/US96/14589

§ 371 Date: May 12, 1998

§ 102(e) Date: May 12, 1998

(87) PCT Pub. No.: WO97/10625

PCT Pub. Date: Mar. 20, 1997

(51) Int. Cl.[7] ..... H01R 13/66
(52) U.S. Cl. ..... 439/541.5; 439/676
(58) Field of Search ..... 439/541.5, 676, 439/79, 80, 540.1

(56) References Cited

U.S. PATENT DOCUMENTS

| | | | | |
|---|---|---|---|---|
| 4,103,985 | | 8/1978 | Krolak et al. | 339/126 R |
| 4,444,451 | | 4/1984 | Myers | 339/154 A |
| 4,772,224 | | 9/1988 | Talend | 439/607 |
| 4,909,757 | | 3/1990 | Reed | 439/532 |
| 5,037,330 | | 8/1991 | Fulponi et al. . | |
| 5,131,866 | | 7/1992 | Bodenweiser et al. | 439/532 |
| 5,213,522 | | 5/1993 | Kojima | 439/620 |
| 5,456,619 | | 10/1995 | Belopolsky et al. | 439/620 |
| 5,531,612 | * | 7/1996 | Goodall et al. | 439/541.5 |
| 5,562,507 | * | 10/1996 | Kan | 439/676 |
| 5,639,267 | * | 6/1997 | Loudermilk | 439/676 |
| 5,645,449 | * | 7/1997 | Sabo | 439/540.1 |
| 5,773,763 | * | 6/1998 | Stachulla | 439/540.1 |
| 5,876,240 | * | 3/1999 | Derstine et al. | 439/79 |
| 5,879,199 | * | 3/1999 | Belopolsky | 439/676 |

FOREIGN PATENT DOCUMENTS

| | | | |
|---|---|---|---|
| 295 19 934 U1 | 4/1996 | (DE) | 23/68 |
| 0 658 953 A2 | 6/1992 | (EP) | 23/68 |

* cited by examiner

*Primary Examiner*—Renee Luebke
*Assistant Examiner*—Briggitte R. Hammond
(74) *Attorney, Agent, or Firm*—Brian J. Hamilla; M. Richard Page; Steven Reiss

(57) ABSTRACT

Disclosed is a double row modular gang jack for board edge application. A plurality of vertical walls are interposed between first and second longitudinal horizontal walls, and another plurality of vertical walls are interposed between the second and third horizontal longitudinal wall. Parallel rows of plug receiving recesses are consequently formed between the first and second and the second and third longitudinal horizontal walls. One of the longitudinal walls extends transversely beyond the edges of the other two to enable the plugs inserted in one row of the plug receiving recesses to be superimposed over the plugs inserted in the other row of plug receiving recesses.

30 Claims, 9 Drawing Sheets

DOUBLE ROW MODULAR GANG JACK FOR BOARD EDGE APPLICATION

This application is a national stage filing under 35 U.S.C. § 371 of International Application PCT/US96/14589, filed on Sep. 12, 1996, which claims priority to U.S. application 08/520,735, filed on Sep. 11, 1995 and now abandoned.

BACKGROUND OF THE INVENTION

1. Field of the Invention

The present invention relates to electrical connectors and more particularly to modular gang jack connectors.

2. Brief Description of the Prior Developments

The prior art discloses modular gang jacks having a plurality of plug receiving recesses. Heretofore, however, modular gang jacks have not been configured to allow for the positioning of one horizontal row of plugs above a second horizontal row of plugs. There is, therefore, a need for a modular gang jack which allows such positioning of plugs on the edge of a printed wiring board.

SUMMARY OF THE INVENTION

In the modular gang jack assembly of the present invention the first, the second and third longitudinal horizontal walls are positioned in parallel spaced relation. A plurality of vertical walls are interposed between the first and second longitudinal horizontal walls, and another plurality of vertical walls are interposed between the second and third horizontal longitudinal walls. Parallel rows of plug receiving recesses are consequently formed between the first and second and the second and third longitudinal horizontal walls. One of the longitudinal walls extends transversely beyond the edges of the other two to enable the plugs inserted in one row of the plug receiving recesses to be superimposed over the plugs inserted in the other row of plug receiving recesses. The assembly may be through mounted or surface mounted on a printed circuit board. The assembly may also have longitudinal vertical walls to be vertically mounted on a printed circuit board.

BRIEF DESCRIPTION OF THE DRAWINGS

The present invention is further described with reference to the accompanying drawings in which.

DETAILED DESCRIPTION OF THE PREFERRED EMBODIMENT

Figure 1:
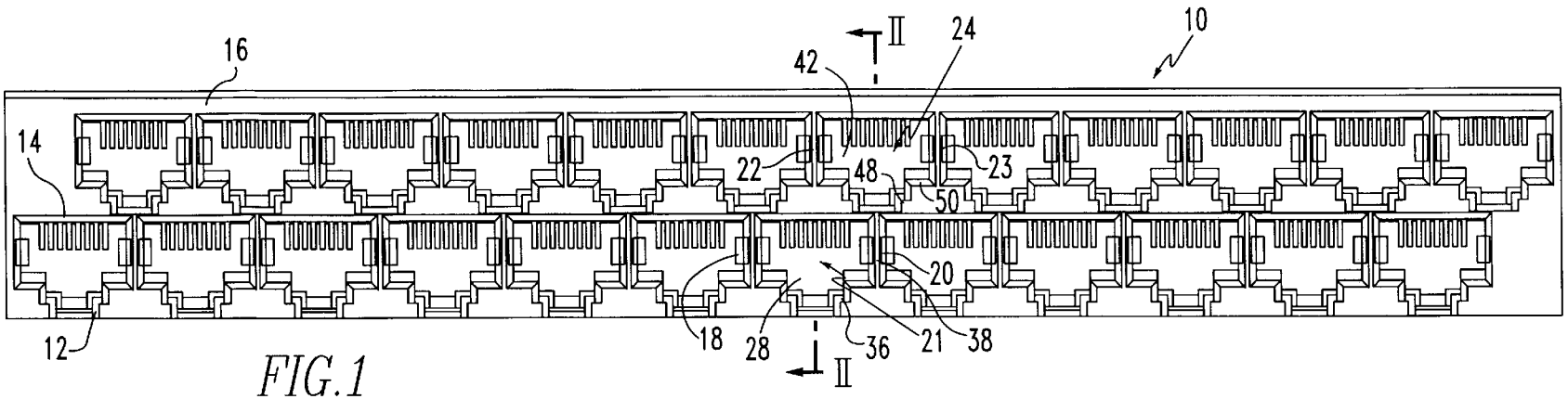
FIG. 1 is a front elevational view of a preferred embodiment of the gang jack assembly of the present invention including two plug elements in phantom lines.
Figure 2:
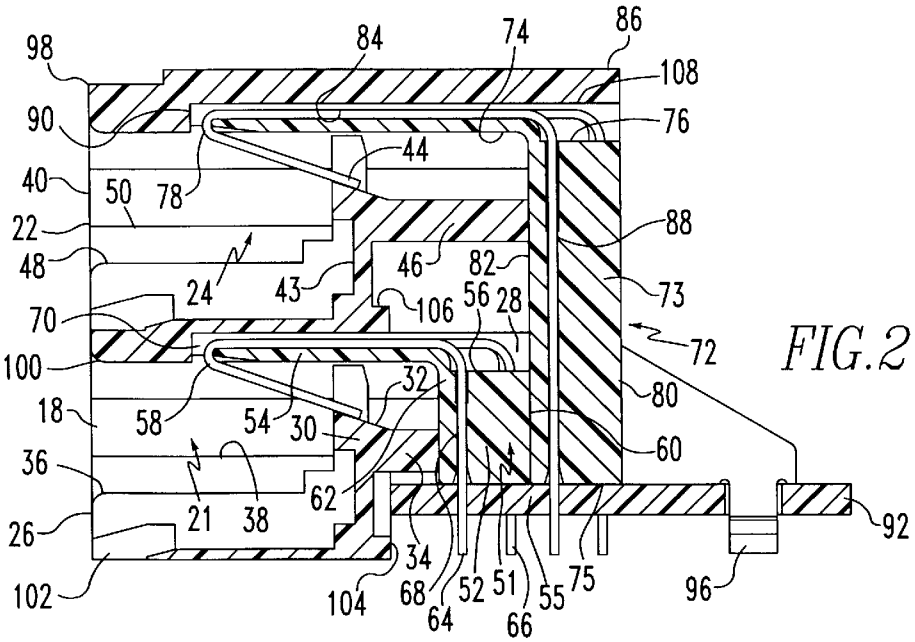
FIG. 2 is a cross sectional view taken through line II—II in FIG. 1.

Referring to FIGS. 1 and 2, the insulated housing element is shown generally at numeral 10. This insulative housing element is made up of a lower horizontal first longitudinal wall 12, a medial second longitudinal wall 14 and an upper third longitudinal wall 16. Connecting the first and second longitudinal walls are lower lateral walls as at 18 and 20 which form with the first and second longitudinal walls lower plug receiving cavities as at numeral 21 generally. Connecting the second and third longitudinal walls are upper lateral walls as at 22 and 23 which form a row of upper plug receiving cavities as at 24. Lower plug receiving cavity 21 is typical of all the plug receiving cavities in its row and it includes a forward opened end 26, a rear opened end 28, a medial wall 30 which has an inclined top side 32 and a transverse extension 34. It will also be noted that the walls as at 20 have a first step 36 and a second step 38. The upper cavities as at 24 have a forward open end 40, a rear opened end 42, a medial wall 43 with inclined lower side 44 and a lateral extension 46. The upper lateral walls as at 24 also have a first step as at 48 and a second step as at 50. Inserted in the lower cavity is a first lower plug insert shown generally at 51 which has a vertical section 52 and a horizontal section 54. There is a base side 55, on the bottom of the vertical section and a top side 56 which extends from the top of the base section over the top of the horizontal section. There is also a forward end 58 at the front of the horizontal section and a rear end 60 on the rearward surface of the vertical section. Opposite this rear end on the vertical section there is a medial vertical surface 62. Conductive wires as at 64 and 66 extend through the vertical section in bores as at 68. These bores connect with grooves as at 70 in the top side into which the wires extend horizontally to the forward end and then extend downwardly and rearwardly to be supported on the inclined top side of the medial wall. Inserted in the upper cavities are second top inserts as is shown generally in numeral 72. These inserts have a vertical section 73 and a horizontal section 74. At the bottom of the vertical section there is a base side 75 and there is an opposed top side 76. At the front of the horizontal section there is a forward end 78 and at the rear of the horizontal section is a rear end 80 opposite from that rear end on the vertical section there is a medial vertical surface 82. Conductive wires as at 84 and 86 extend through the vertical section in bores as at 88 which connect the grooves as at 90 that convey the wires to the forward end from where they extend downwardly and rearwardly to be supported on the inclined surface of the medial wall. The conductive wires from both the first and second inserts are connected to a printed wiring board 92 which has an integral pin 96. The first, second and third horizontal longitudinal walls have respectively front edges 98, 100 and 102. These walls also have, respectfully, rear edges 104, 106 and 108. It will be seen that the upper third board stands transversely beyond the first and second board so that the rear edge 108 of the upper third board is vertically misaligned with the rear edges 104 and 106 of the first and second horizontal wall. Consequently it will be seen that it is possible to insert the lower plug into the lower cavity and then insert the upper plug into the upper cavity such that the upper plug is superimposed over the lower plug and the medial vertical surface 82 of the upper plug abuts the rear end 60 of the lower insert.

Figure 3:
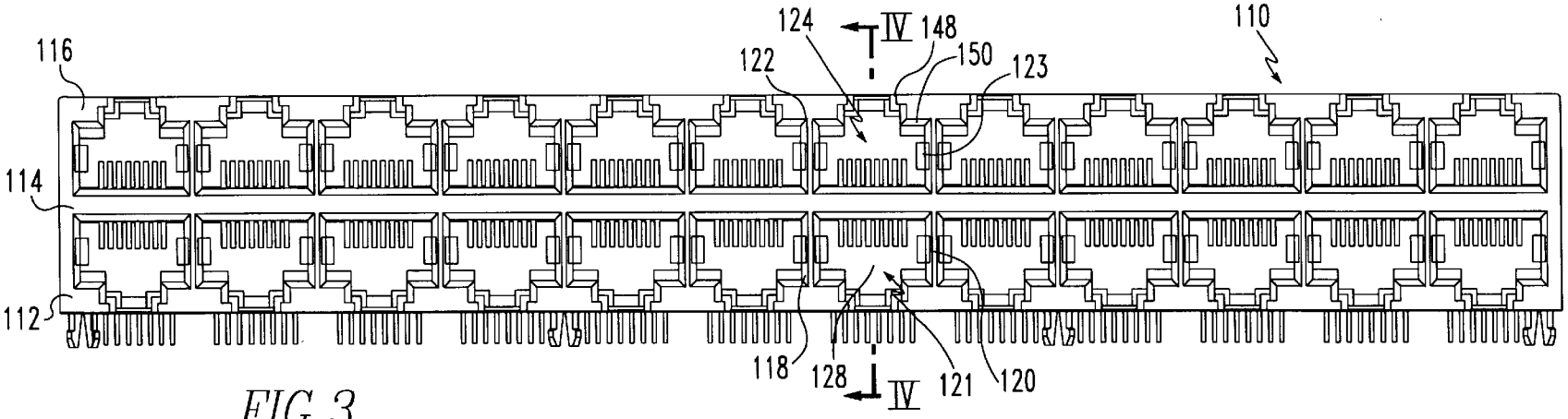
FIG. 3 is a front elevational view of a second preferred embodiment of the modular gang jack of the present invention with two plug elements shown in phantom lines.
Figure 4:
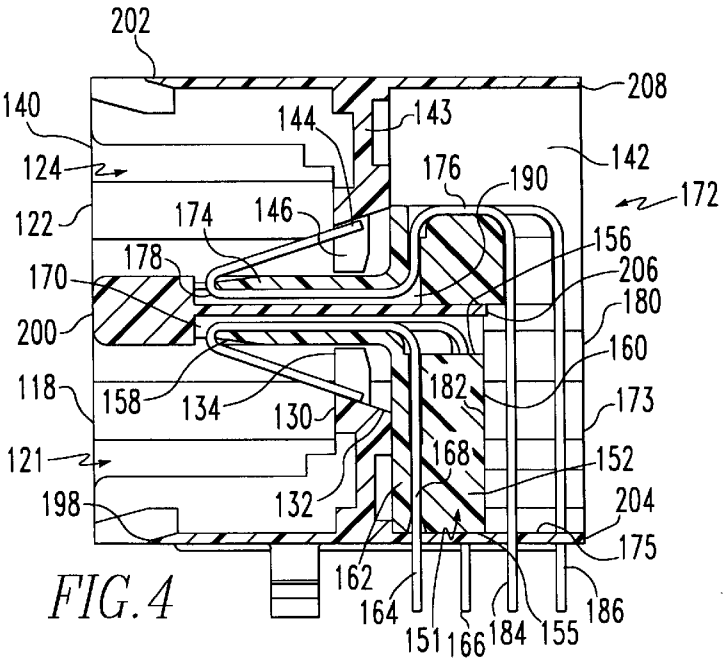
FIG. 4 is a cross section taken through line IV—IV in FIG. 3.

Referring to FIGS. 3 and 4, the insulated housing element is shown generally at numeral 110. This insulative housing element is made up of a lower horizontal first longitudinal wall 112, a medial second longitudinal wall 114 and an upper third longitudinal wall 116. Connecting the first and second longitudinal walls are lower lateral walls as at 118 and 120 which form with the first and second longitudinal walls lower plug receiving cavities as at 121. Connecting the second and third longitudinal walls are upper lateral walls as at 122 and 123 which form a row of upper plug receiving cavities as at 124. Lower plug receiving cavity 121 is typical of all the plug receiving cavities in its row and it includes a forward opened end 126, a rear opened end 128, a medial wall 130 which has an inclined top side 132 and a transverse extension 134. It will also be noted that the walls as at 120 have a first step 136 and a second step 138. The upper cavities as at 124 have a forward open end 140, a rear opened end 142, a downwardly extending medial wall 143 with inclined lower side 144 and a lateral extension 146. The upper lateral walls as at 124 also have a first step as at 148 and a second step as at 150. Inserted in the lower cavity is a first lower insert shown generally at 151 which has a vertical section 152 and a horizontal section 154. There is a base side 155, upper bottom of the vertical section and a top side 156 which extends from the top of the base section over the top of the horizontal section. There is also a forward end 158 at the front of the horizontal section and a rear end 160 on the rearward surface of the vertical section. Opposite this rear end on the vertical section there is a medial vertical surface 162. Conductive wires as at 164 and 166 extend through the vertical section in bores as at 168. These bores connect with grooves as at 170 in the top side into which the wires extend horizontally to the forward end and then extend downwardly and rearwardly to be supported on the inclined top side of the medial wall. Inserted in the upper cavities are second top inserts as is shown generally in numeral 172. These inserts have a vertical section 173 and a horizontal section 174. At the bottom of the vertical section there is a base side 175 and there is an opposed top side 176. At the front of the horizontal section there is a forward end 178 and at the rear of the horizontal section is a rear end 180 in opposed relation to that rear end on the vertical section 173 of the second insert there is a medial vertical surface 182. Conductive wires as at 184 and 186 extend through the vertical section in bores as at 188 which connect the grooves as at 190 that convey the wires first laterally, then downwardly, then downwardly again to the forward end from where they extend upwardly and rearwardly to be supported on the lower inclined surface 144 of the downwardly extending medial wall 143. The conductive wires from both the first and second inserts are connected to a printed wiring board 192 which has an integral pin 196. The first, second and third horizontal longitudinal walls have respectively front edges 198, 200 and 202. These walls also have, respectfully, rear edges 204, 206 and 208. It will be seen that the upper third board stands transversely beyond the first and second board so that the rear edge 208 of the upper third board is vertically misaligned with the rear edges 204 and 206 of the first and second horizontal wall, consequently it will be seen that it is possible to insert the lower plug into the lower cavity and then insert the upper plug into the upper cavity such that the upper plug is superimposed over the lower plug and the medial vertical surface 182 of the upper plug abuts the rear end 160 of the lower insert.

Figure 5:
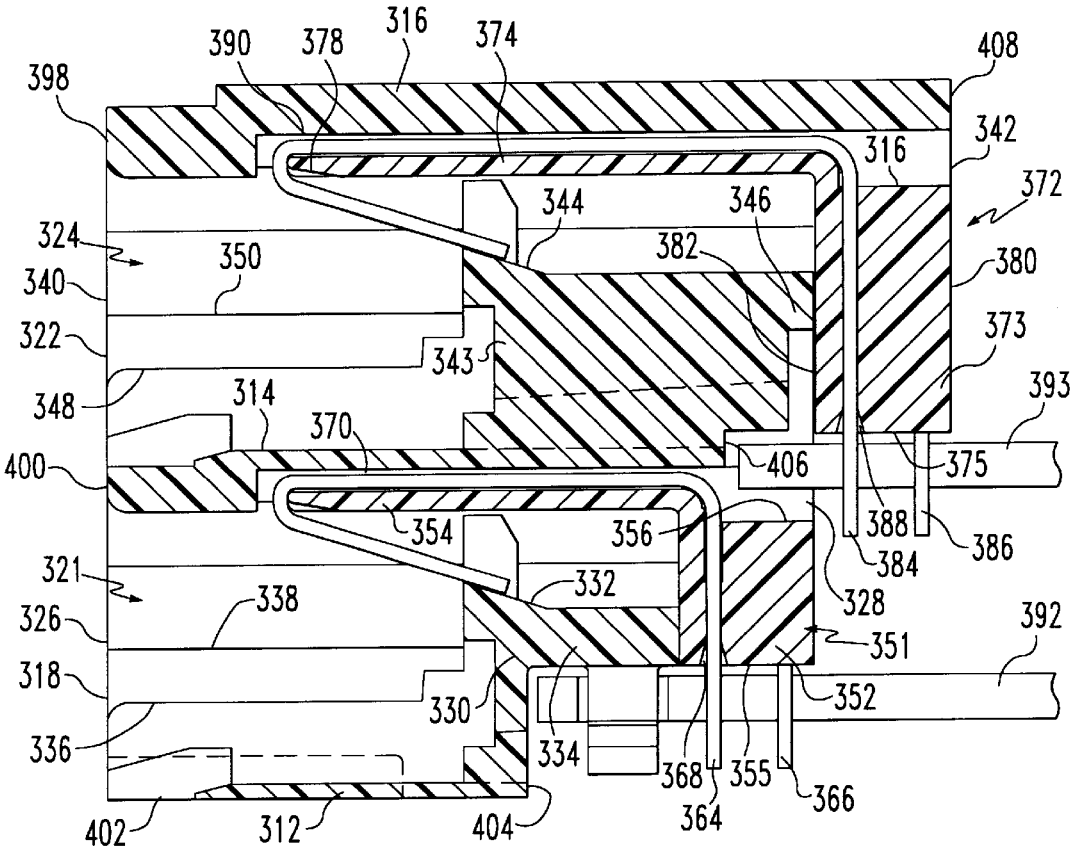
FIG. 5 is a cross sectional view similar to FIG. 4 of a third preferred embodiment of the modular gang jack of the present invention.

Referring to FIG. 5, a third preferred embodiment of the insulated housing element is shown generally at numeral 310. This insulative housing element is made up of a lower horizontal first longitudinal wall 312, a second longitudinal wall 314 and an upper third longitudinal wall 316. Connecting the first and second longitudinal walls are lower lateral walls as at 318 which form with the first and second longitudinal walls lower plug receiving cavities as at 321. Connecting the second and third longitudinal walls are upper lateral walls as at 322 and 323 which form a row of upper plug receiving cavities as at 324. Lower plug receiving cavity 321 is typical of all the plug receiving cavities in its row and it includes a forward opened end 326, a rear opened end 328, a medial wall 330 which has an inclined top side 332 and a transverse extension 334. It will also be noted that the walls as at 320 have a first step 336 and a second step 338. The upper cavities as at 324 have a forward open end 340, a rear opened end 342, a medial wall 343 with inclined lower side 344 and a lateral extension 346. The upper lateral walls as at 324 also have a first step as at 348 and a second step as at 350. Inserted in the lower cavity is a first lower insert shown generally at 351 which has a vertical section 352 and a horizontal section 354. There is a base side 355 and at the upper end of the vertical section, a top side 356 which extends from the top of the base section over the top of the horizontal section. There is also a forward end 358 at the front of the horizontal section and a rear end 360 on the rearward surface of the vertical section. Opposite this rear end on the vertical section there is a medial vertical surface 362. Conductive wires as at 364 and 366 extend through the vertical section in bores as at 368. These bores connect with grooves as at 370 in the top side into which the wires extend horizontally to the forward end and then extend downwardly and rearwardly to be supported on the inclined top side of the medial wall. Inserted in the upper cavities are second top inserts as is shown generally in numeral 372. These inserts have a vertical section 373 and a horizontal section 374. At the bottom of the vertical section there is a base side 375 and there is an opposed top side 376. At the front of the horizontal section there is a forward end 378 and at the rear of the horizontal section is a rear end 380 in opposed relation to that rear end on the vertical section there is a medial vertical surface 382. Conductive wires as at 384 and 386 extend through the vertical section in bores as at 388 which connect the grooves as at 390 that convey the wires to the forward end from where they extend downwardly and rearwardly to be supported on the lower inclined surface of the medial wall. The conductive wires from both the first and second inserts are connected to a printed wiring board 392 which has an integral pin 396. The first, second and third horizontal longitudinal walls have respectively front edges 398, 400 and 402. These walls also have, respectfully, rear edges 404, 406 and 408. It will be seen that the upper third board stands transversely beyond the first and second board so that the rear edge 408 of the upper third board is vertically misaligned with the rear edges 404 and 406 of the first and second horizontal wall, consequently it will be seen that it is possible to insert the lower plug into the lower cavity and then insert the upper plug into the upper cavity such that the upper plug is superimposed over the lower plug and the medial vertical surface 382 of the upper plug abuts the rear end 360 of the lower insert.

Figure 6:
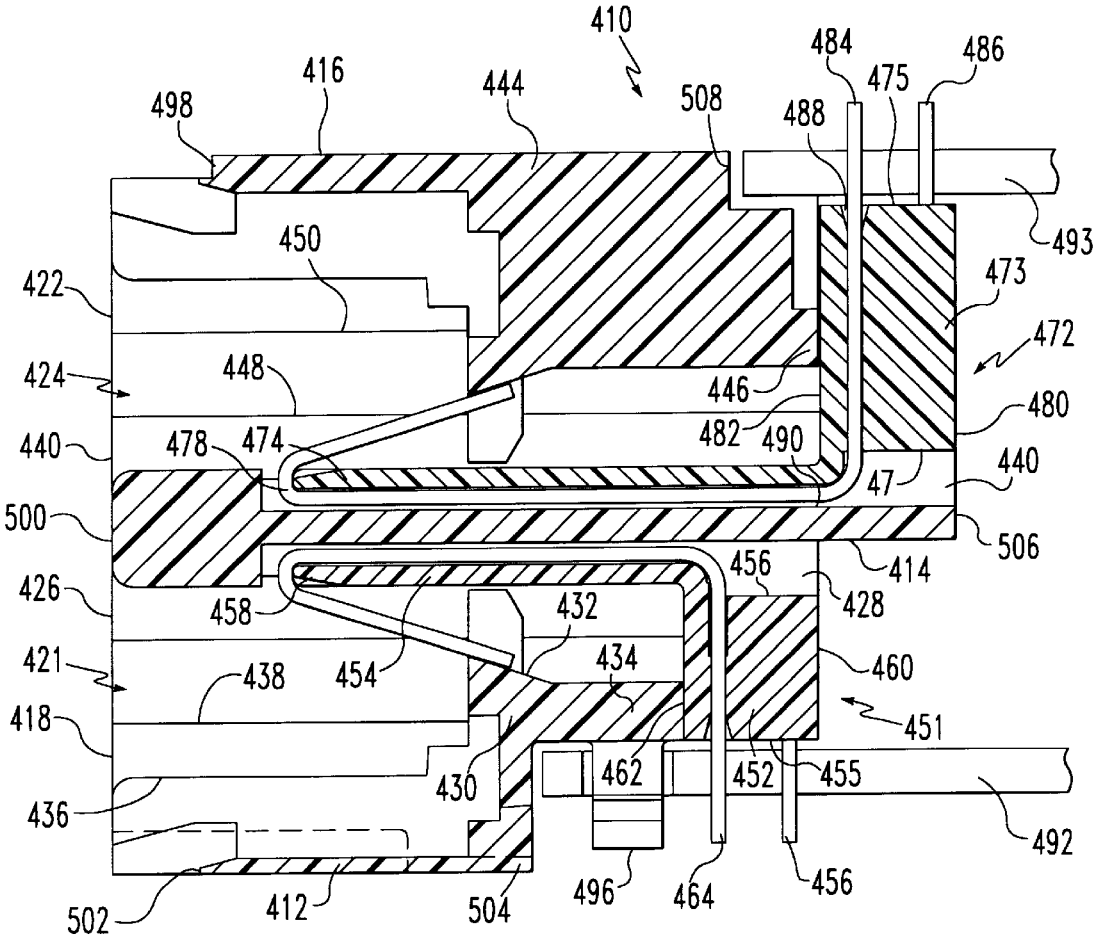
FIG. 6 is another view similar to FIG. 4 of a fourth preferred embodiment of the modular gang jack of the present invention.

Referring to FIG. 6, a fourth preferred embodiment of the insulated housing element is shown generally at numeral 410. This insulative housing element is made up of a lower horizontal first longitudinal wall 412, a second longitudinal wall 414 and an upper third longitudinal wall 416. Connecting the first and second longitudinal walls are lower lateral walls as at 418 which form with the first and second longitudinal walls lower plug receiving cavities as at 421. Connecting the second and third longitudinal walls are upper lateral walls as at 422 which form a row of upper plug receiving cavities as at 424. Lower plug receiving cavity 421 is typical of all the plug receiving cavities in its row and it includes a forward opened end 426, a rear opened end 428, a medial wall 430 which has an inclined top side 432 and a transverse extension 434. It will also be noted that the walls as at 420 have a first step 436 and a second step 438. The upper cavities as at 424 have a forward open end 440, a rear opened end 442, a downwardly extending medial wall 443 with an inclined bottom side 444 and a lateral extension 446. The upper lateral walls as at 422 also have a first step as at 448 and a second step as at 450. Inserted in the lower cavity is a first lower insert shown generally at 451 which has a vertical section 452 and a horizontal section 454. There is a base side 455, of the vertical section and a top side 456 which extends from the top of the base section over the top of the horizontal section. There is also a forward end 458 at the front of the horizontal section and a rear end 460 on the rearward surface of the vertical section. Opposite this rear end on the vertical section there is a medial vertical surface 462. Conductive wires as at 464 and 466 extend through the vertical section in bores as at 468. These bores connect with grooves as at 470 in the top side into which the wires extend horizontally to the forward end and then extend downwardly and rearwardly to be supported on the inclined top side of the medial wall. Inserted in the upper cavities are second top inserts as is shown generally in numeral 472. These inserts have a vertical section 473 and a horizontal section 474. At the top of the vertical section there is a base side 475 and there is an opposed bottom side 476. At the front of the horizontal section there is a forward end 478 and at the rear of the horizontal section is a rear end 480. In opposed relation to that rear end on the vertical section there is a medial vertical surface 482. Conductive wires as at 484 and 486 extend through the vertical section in bores as at 488 which connect the grooves as at 490 that convey the wires to the forward end from where they extend downwardly and rearwardly to be supported on the lower inclined surface of the medial wall. The conductive wires from the first insert are connected to a printed wiring board 492 which has an integral pin 496. The conductive wires from the second insert are connected to another printed wiring board 493. The first, second and third horizontal longitudinal walls have respectively front edges 498, 500 and 502. These walls also have, respectfully, rear edges 504, 506 and 508. It will be seen that the medial second board stands transversely beyond the first and second board so that the rear edge 508 of the upper third board is vertically misaligned with the rear edges 504 and 506 of the first and second horizontal wall, consequently it will be seen that it is possible to insert the lower plug into the lower cavity and then insert the upper plug into the upper cavity such that the upper plug is superimposed over the lower plug and the medial vertical surface 482 of the upper plug abuts the rear end 460 of the lower insert.

Figure 7:
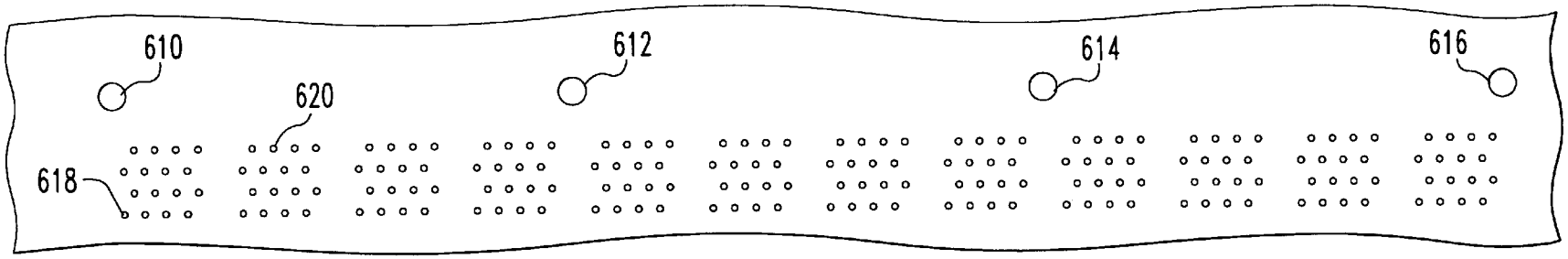
FIG. 7 is a top plan view of a printed circuit board for receiving the modular gang jack shown in FIGS. 1–6.

Referring to FIG. 7, a printed wiring board for use with the modular gang jack of the present invention would include a plurality of pin receiving apertures as at 610, 612, 614 and 616. It would also include groups of conductive leads receiving apertures as at 618 and 620.

Figure 8:
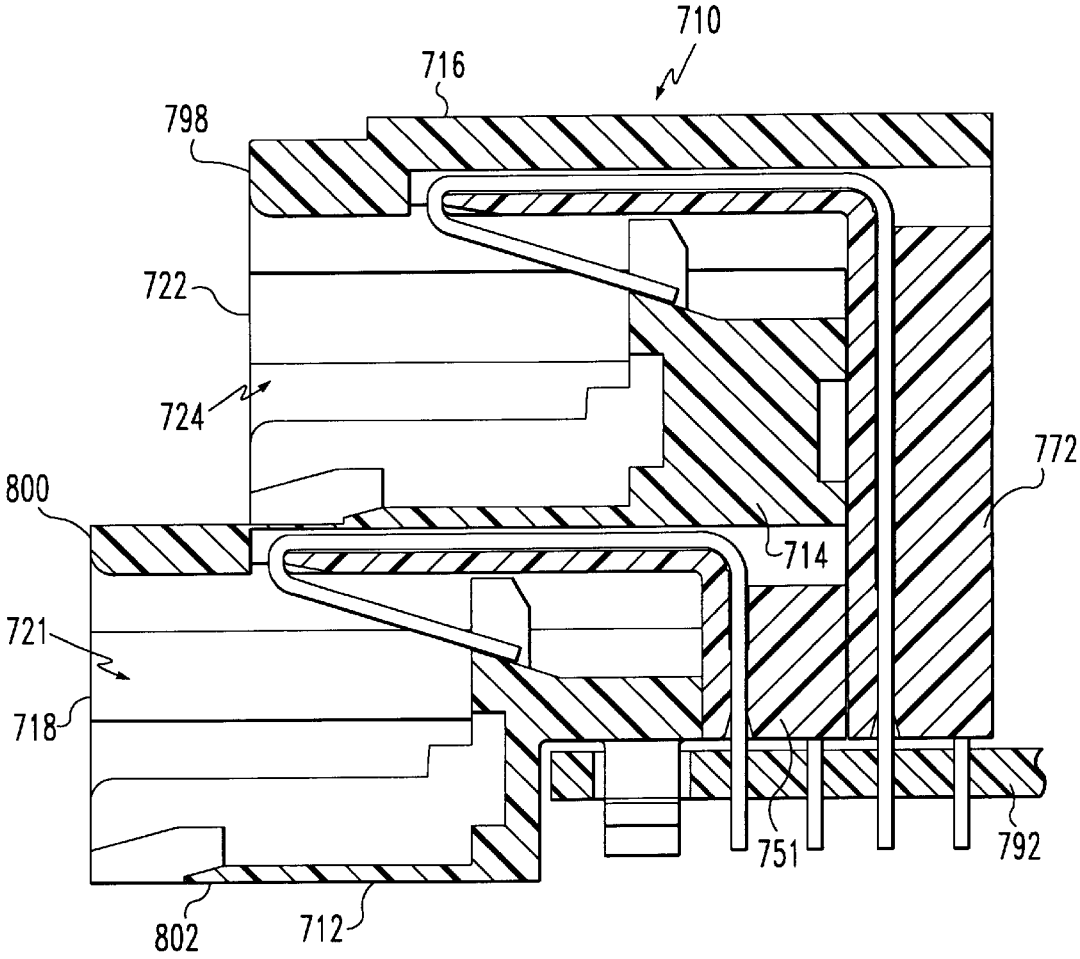
FIG. 8 is a vertical cross sectional view similar to FIG. 4 of a fifth preferred embodiment of the modular gang jack of the present invention.

Referring to FIG. 8, a fifth preferred embodiment of the insulated housing element is shown generally at numeral 710. This insulative housing element is made up of a lower horizontal first longitudinal wall 712, a second longitudinal wall 714 and an upper third longitudinal wall 716. Connecting the first and second longitudinal walls are lower lateral walls as at 718 which form with the first and second longitudinal walls lower plug receiving cavities as at 721. Connecting the second and third longitudinal walls are upper lateral walls as at 722 which form a row of upper plug receiving cavities as at 724. The plug receiving cavities are similar to those described above. Inserted in the lower cavity is a first lower insert shown generally at 751 which is similar to the inserts described above. Inserted in the upper cavities is a second top insert as is shown generally in numeral 772 which is also similar to the inserts described above. The conductive wires from the first insert and second insert are connected to a printed wiring board 792. The first, second and third horizontal longitudinal walls have respectively front edges 798, 800 and 802. It will be seen that front edge 798 is displaced rearwardly from front edges 800 and 802 so that the front faces of the upper and lower housings are vertically misaligned in a non-coincident stair step arrangement.

Figure 9:
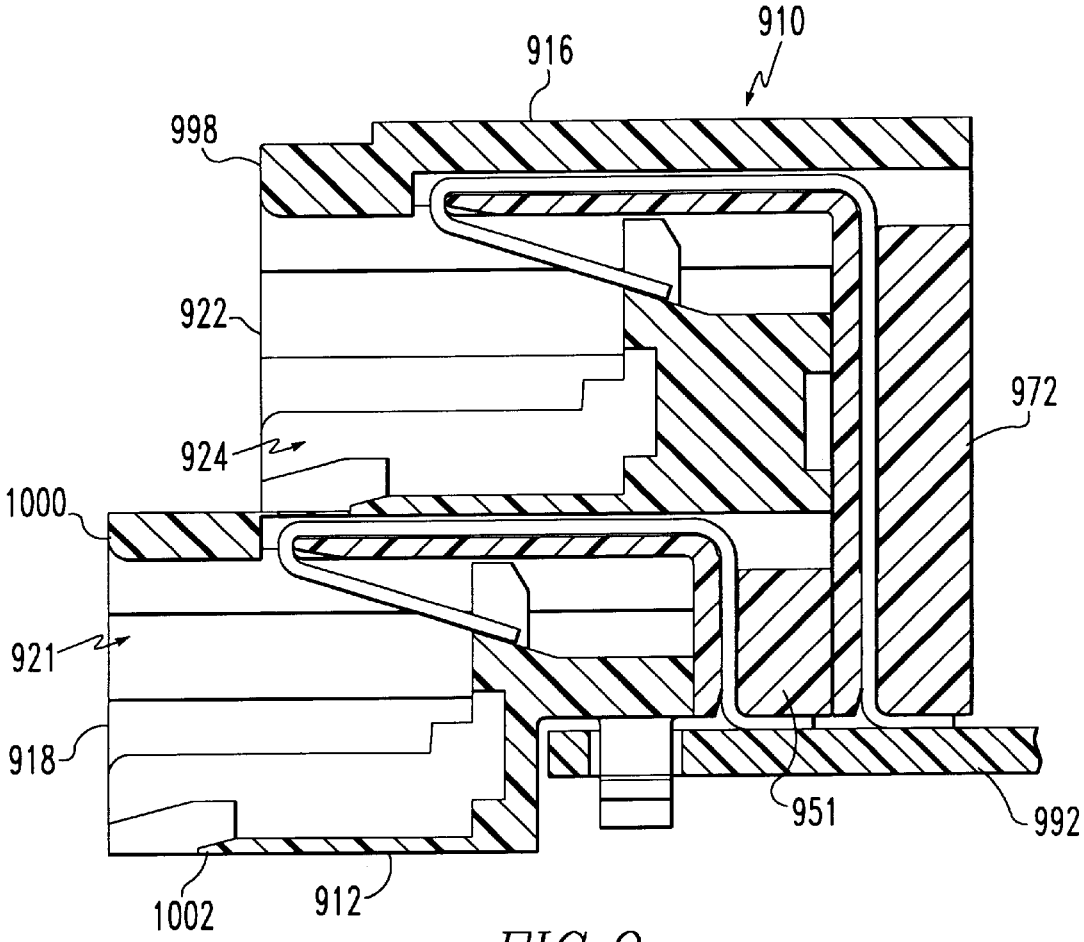
FIG. 9 is a vertical cross sectional view similar to FIG. 4 of a sixth preferred embodiment of the modular gang jack of the present invention.

Referring to FIG. 9, a sixth preferred embodiment of the insulated housing element is shown generally at numeral 910. This insulative housing element is made up of a lower horizontal first longitudinal wall 912, a second longitudinal wall 914 and an upper third longitudinal wall 916. Connecting the first and second longitudinal walls is a lower lateral wall as at 918 which forms with the first and second longitudinal walls lower plug receiving cavities as at 921. Connecting the second and third longitudinal walls are upper lateral walls as at 922 which form a row of upper plug receiving cavities as at 924. The plug receiving cavities are similar to those described above. Inserted in the lower cavity is a first lower insert shown generally at 951 which is similar to those described above. Inserted in the upper cavities are second top inserts as is shown generally at numeral 972 which are similar to those inserts described above. The conductive wires from the first insert and second insert are surface mounted on a printed wiring board 992. The first, second and third horizontal longitudinal walls have respectively front edges 998, 1000 and 1002, and front edge 998 is recessed forward from the other two front edges 1000 and 1002.

Figure 10:
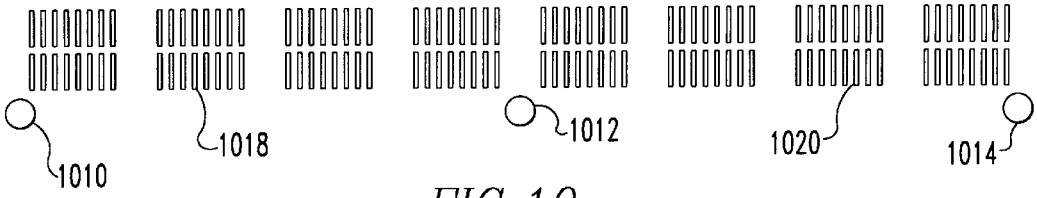
FIG. 10 is a top plan view of a printed circuit board for receiving the modular gang jack shown in FIG. 9.

Referring to FIG. 10, a printed wiring board for use with the surface mounted modular gang jack of the present invention would include a plurality of placement pin receiving apertures as at 1010, 1012 and 1014. It would also include groups of conductive pads as at 1018 and 1020.

Figure 11:
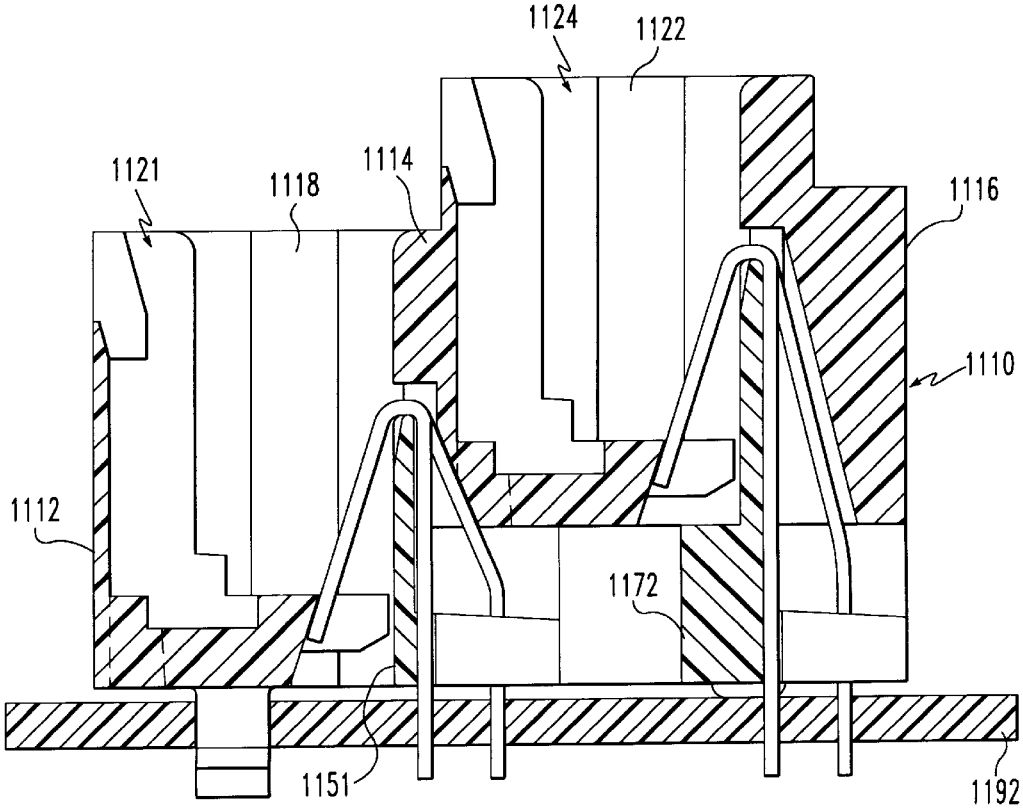
FIG. 11 is a vertical cross sectional view similar to FIG. 4 of a seventh preferred embodiment of the modular gang jack of the present invention.

Referring to FIG. 11, a seventh preferred embodiment of the insulated housing element is shown generally at numeral 1110. This insulative housing element is made up of a vertical first longitudinal wall 1112, a vertical second longitudinal wall 1114 and a vertical third longitudinal wall 1116. Connecting the first and second longitudinal walls are lateral walls as at 1118 which form with the first and second longitudinal walls plug receiving cavities as at 1121. Connecting the second and third longitudinal walls are lateral walls as at 1122 which form a row of plug receiving cavities as at 1124. The plug receiving cavities are similar to those described above. Inserted in the lower cavity is a first lower insert shown generally at 1151 which is generally similar to those described above. Inserted in the upper cavities are second top inserts as is shown generally in numeral 1172 which are generally similar to those inserts described above. These inserts vertically engage printed circuit board 1192.

Figure 12:
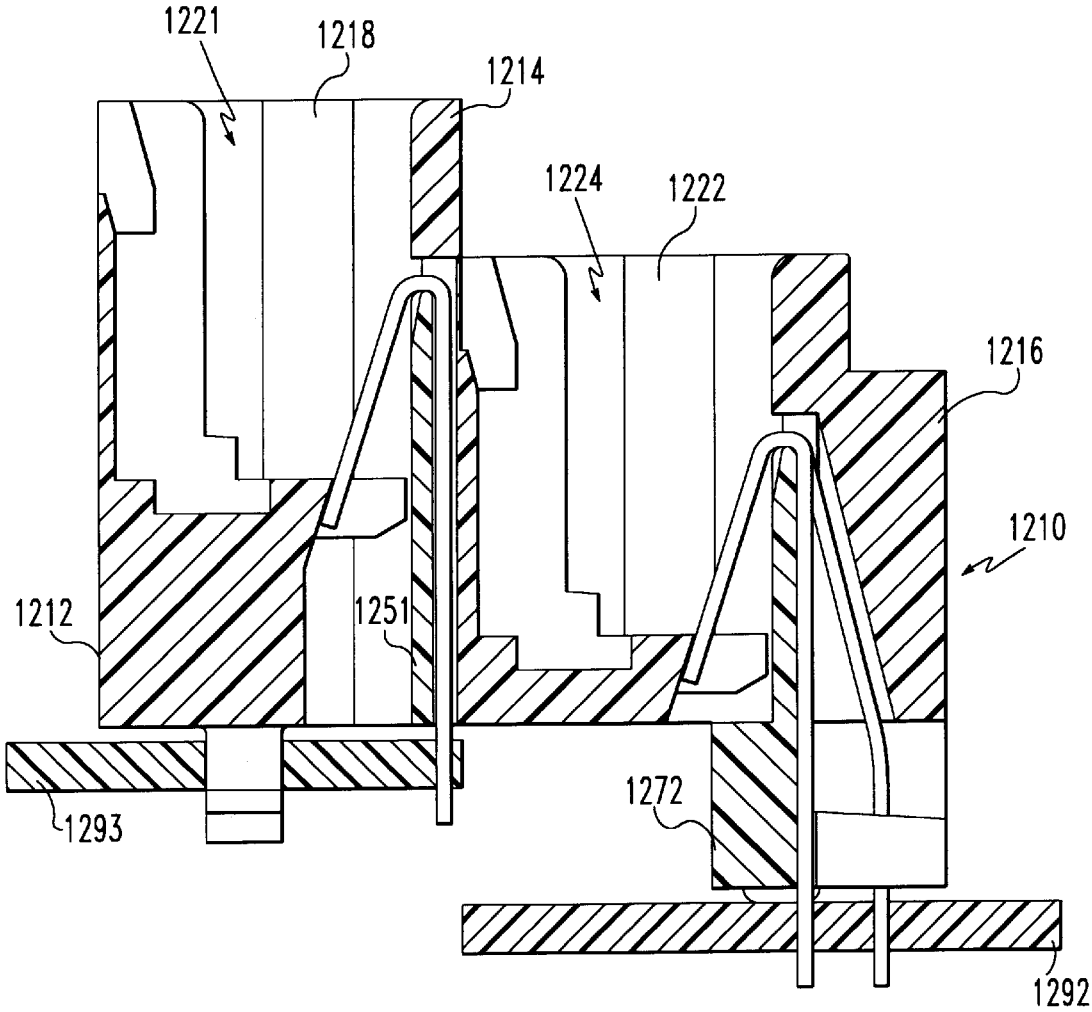
FIG. 12 is a vertical cross sectional view similar to FIG. 4 of an eighth preferred embodiment of the modular gang jack of the present invention.

Referring to FIG. 12, an eighth preferred embodiment of the insulated housing element is shown generally at numeral 1210. This insulative housing element is made up of a vertical horizontal first longitudinal wall 1212, a vertical second longitudinal wall 1214 and a vertical third longitudinal wall 1216. Connecting the first and second longitudinal walls are lateral walls as at 1218 which form with the first and second longitudinal walls plug receiving cavities as at 1221. Connecting the second and third longitudinal walls are lateral walls as at 1222 which form a row of plug receiving cavities as at 1224. The plug receiving cavities are similar to those described above. Inserted in the other cavity is a first lower insert shown generally at 1251 which is generally similar to those described above. Inserted in the other cavities are second inserts as is shown generally in numeral 1272 which are generally similar to those described above. Insert 1272 is mounted on printed circuit board 1292. Insert 1251 is mounted on another printed circuit board 1293 which is parallel to and vertically displaced from board 1292.

It will be appreciated that a modular gang jack assembly which provides an efficient and economical means for positioning a double row of plugs on the edge of a printed wiring board.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An insulative housing for use in a modular jack assembly comprising first, second and third longitudinal walls positioned such that said second longitudinal wall is superimposed over said first longitudinal wall in spaced parallel relation and said third longitudinal wall is superimposed over said second longitudinal wall in spaced parallel relation and a first pair of spaced lateral walls is interposed between the first and second longitudinal walls in perpendicular relation to said first and second longitudinal walls to form a first transverse plug receiving cavity and a second pair of spaced lateral walls is interposed between the second and third longitudinal walls in perpendicular relation to said second and third longitudinal walls to form a second transverse plug receiving aperture, and a first medial wall extending from the first longitudinal wall into the first transverse plug receiving cavity and said first medial wall having a first distal side which is in spaced relation from the second longitudinal wall, and a second medial wall extending from the second longitudinal wall into the second transverse plug receiving cavity and said second medial wall having a second distal side which is in spaced relation from the third longitudinal wall, and wherein the walls in the first pair of spaced lateral walls are misaligned from the walls in the second pair of spaced lateral walls.

2. The insulative housing of claim 1 wherein the first and second distal sides of the first and second medial walls are sloped.

3. The insulative housing of claim 1 wherein said longitudinal walls each have front and rear edges and the rear edges of at least two of said longitudinal walls are misaligned.

4. The insulative housing of claim 3 wherein the first, second and third longitudinal walls are vertically spaced.

5. The insulative housing of claim 4 wherein the rear edges of at least two of said longitudinal walls are vertically misaligned.

6. The insulative housing of claim 5 wherein the rear edge of the third longitudinal wall, is positioned transversely beyond the rear edges of the first and second longitudinal walls.

7. The insulative housing of claim 6 wherein the rear edges of the first and second longitudinal walls are vertically aligned.

8. The insulative housing of claim 7 wherein the first longitudinal wall is mounted on a printed wiring board.

9. The insulative housing of claim 3 wherein the front edges of at least two of the longitudinal walls are misaligned.

10. The insulative housing of claim 9 wherein insulative inserts are positioned in the plug receiving cavities.

11. The insulative housing of claim 10 wherein said housing and inserts are mounted on a printed circuit board.

12. The insulative housing of claim 1 wherein the first, second and third longitudinal walls are horizontal and the first and second pair of spaced lateral walls are vertical.

13. The insulative housing of claim 12 wherein the first pair of spaced lateral walls are misaligned from the second pair of spaced lateral walls.

14. A modular jack assembly comprising:

(a) an insulative housing for use in a modular jack assembly comprising first, second and third longitudinal walls positioned such that said second longitudinal wall is superimposed over said first longitudinal wall in spaced parallel relation and said third longitudinal wall is superimposed over said second longitudinal wall in spaced parallel relation and a first pair of lateral walls is interposed between the first and second longitudinal walls to form a first transverse plug receiving cavity and a second pair of lateral walls is interposed between the second and third longitudinal walls to form a second transverse plug receiving cavity;

(b) a first insulative insert having base and upper sides and rear and terminal ends and being positioned such that its terminal end extends into the first plug receiving cavity and its upper side is adjacent the second longitudinal wall; and (c) a second insulative insert having base and upper sides and rear and terminal ends and being positioned so that its terminal end extends into the second plug receiving cavity and its upper side is adjacent the third longitudinal wall, and wherein the walls in the first pair of spaced lateral walls are misaligned from the walls in the second pair of spaced lateral walls.

15. The modular jack assembly of claim 14 wherein the insulative inserts each have a medial wall opposed to each of their rear ends and the second insert is superimposed over the first insert such that the medial wall of the second insulative insert abuts the rear end of the first insulative insert.

16. The modular jack assembly of claim 14 wherein on the first insulative insert the conductive elements extend vertically from the base side to the upper side of the insulative insert and then generally horizontally to the terminal end of the insulative insert and then downwardly and rearwardly toward the rear end of the first insulative insert and the conductive elements extend vertically from the base side of the insulative insert and then generally horizontally to the terminal end and then upwardly and rearwardly toward the rear end of the first insulative insert and the conductive means extends vertically from the base side of the insulative insert and then generally horizontally to the terminal end and then upwardly and rearwardly toward the rear end of the second insulative insert.

17. The modular jack assembly of claim 14 wherein the insulative inserts each have a medial wall opposed to each of their rear ends and the second insert is superimposed over the first insert such that the medial wall of the second insulative insert is vertically aligned with the rear end of the first insulative insert.

18. The modular jack assembly of claim 14 wherein conductive elements extend vertically from the base side to the upper side of each of the insulative inserts and then generally horizontally to the terminal end of the insulative insert and then downwardly and rearwardly toward the rear end of the insulative insert.

19. The modular jack assembly of claim 18 wherein the conductive elements extend downwardly below the base side of the insulative insert.

20. The modular jack assembly of claim 19 wherein there are a plurality of generally parallel conductive elements which extend vertically from the base side to the upper side of the insulative insert and then generally horizontally to the terminal end of the insulative insert and then downwardly and rearwardly toward the rear end of the insulative housing.

21. The modular jack assembly of claim 20 wherein each of the conductive elements extend vertically from the base side to the upper side in a base and then extends in a groove on the upper side of the insert.

22. The modular jack assembly of claim 14 wherein in the insulative housing the first medial wall extends from the first longitudinal wall into the first transverse plug receiving cavity and said first medial wall has a first distal side which is in spaced relation from the second longitudinal wall, and a second medial wall extends from the second longitudinal wall into the second transverse plug receiving cavity and said second medial wall has a second distal side which is in spaced relation from the third longitudinal wall.

23. The insulative housing of claim 22 wherein the first and second distal sides of the first and second medial walls are shaped downwardly respectively toward the rear ends of the first and second inserts.

24. The insulative housing of claim 14 wherein the first, second and third longitudinal walls are horizontal and the first and second pair of spaced lateral walls are vertical.

25. The insulative housing of claim 24 wherein the first pair of spaced lateral walls are vertically misaligned from the second pair of spaced lateral walls.

26. An insulative housing for modular jack assembly having a first horizontal row of plug receiving cavities superimposed over a second horizontal row of plug receiving cavities in a non-aligned, vertically overlapping relation.

27. An insulative housing for use in a modular jack assembly comprising first, second and third longitudinal walls positioned such that said second longitudinal wall is adjacent said first longitudinal wall in spaced parallel relation and said third longitudinal wall is adjacent said second longitudinal wall in spaced parallel relation and a first pair of lateral walls is interposed between the first and second longitudinal walls to form a first transverse plug receiving cavity and a second pair of lateral walls is interposed between the second and third longitudinal walls to form a second transverse plug receiving aperture, said second plug receiving aperture superposed and laterally offset relative to said first plug receiving aperture.

28. The insulative housing of claim 27 wherein insulative inserts are positioned in the plug receiving cavities.

29. An insulative housing for a modular jack assembly, comprising:

a generally planar front face;

a plurality of first openings in said front face for receiving a corresponding plurality of mating plug connectors, said first openings aligned along a first direction to form a first row;

a second plurality of openings in said front face for receiving a corresponding plurality of mating plug connectors, said second openings aligned along said first direction to form a second row, said second row superposed relative to said first row in a second direction;

wherein each of said second openings overlaps, in said second direction and in an offset relationship, at least one of said first openings.

30. The insulative housing as recited in claim 29, wherein each of said second openings overlap two of said first openings.

* * * * *